United States Patent [19]

Jahns

[11] 4,194,856

[45] Mar. 25, 1980

[54] METHOD FOR REDUCING FROST HEAVE OF REFRIGERATED GAS PIPELINES

[75] Inventor: Hans O. Jahns, Houston, Tex.

[73] Assignee: Exxon Production Research Company, Houston, Tex.

[21] Appl. No.: 938,662

[22] Filed: Aug. 31, 1978

[51] Int. Cl.[2] ..... E02D 19/14; F16L 57/00

[52] U.S. Cl. ..... 405/130; 165/45; 405/157; 405/217

[58] Field of Search ..... 405/56, 130, 131, 157, 405/217; 62/260; 165/45

[56] References Cited

U.S. PATENT DOCUMENTS

| | | | |
|---|---|---|---|
| 774,594 | 11/1904 | Moir | 405/130 |
| 3,564,862 | 2/1971 | Hashemi et al. | 405/131 X |
| 3,650,119 | 3/1972 | Sparling | 405/157 X |
| 3,859,800 | 1/1975 | Wuelpern | 405/130 |
| 4,036,286 | 7/1977 | Anderson et al. | 165/45 |

*Primary Examiner*—David H. Corbin
*Attorney, Agent, or Firm*—Michael A. Nametz

[57] ABSTRACT

In order to prevent damage due to frost heaving of a refrigerated gas pipeline which traverses frost-susceptible soil resulting from horizontal ice lense formation beneath the pipeline, heat pipes are located in diametrically opposed pairs, one on either side of the pipeline. Frost bulbs are formed in the soil around each heat pipe adjacent to the pipeline, causing the horizontal ice lenses to be formed further below the pipeline. Heaving rate is reduced due to the lower temperature gradient in the vertical direction, a greater overburden above the horizontal ice lenses and a reduced water supply directly beneath the pipeline. Also, lateral expansion of the frost bulbs provides opposing horizontal forces to counteract the upward force of the horizontal ice lenses.

9 Claims, 8 Drawing Figures

METHOD FOR REDUCING FROST HEAVE OF REFRIGERATED GAS PIPELINES

BACKGROUND OF THE INVENTION

1. Field of the Invention

This invention relates to a method of preventing the deformation of a refrigerated gas pipeline which traverses frost-susceptible soil. In particular, the invention pertains to a method utilizing refrigerating-type heat pipes laterally spaced from the pipeline to remove heat from the soil thereby preventing excessive frost heaving of the pipeline.

2. Description of the Prior Art

Permafrost often has a high water content so that if it becomes thawed to any significant extent, it is unable to adequately support structures on or in it. Heat pipes have been used previously in connection with support piles for pipelines and other structures in order to stabilize the soil in arctic regions where permafrost is prevalent. For example, U.S. Pat. No. 3,859,800 (issued to L. E. Wuelpern on Jan. 14, 1975) teaches the use of piles passively refrigerated by heat pipes for permafrost stabilization of elevated pipelines, and U.S. Pat. No. 3,788,389 (issued to E. D. Waters on Jan. 29, 1974) shows the use of heat pipes for stabilizing soil surrounding structural supports (such as telephone poles).

A different problem exists with refrigerated gas pipelines used to transport arctic gas. These pipelines are refrigerated where they pass through permafrost in order to prevent thaw-settlement of the pipeline and to prevent soil erosion, icings, slope instability and other problems related to thawing permafrost. Also, there are economic incentives for chilling gases in the currently proposed large diameter, high pressure pipelines due to higher gas density, lower flowing pressure losses and lower compression costs at lower temperature. A discussion of refrigerated gas pipelines is given by G. King, "The How and Why of Cooling Arctic Gas Pipelines", Parts I and II, *Pipeline and Gas Journal* (September and October, 1977).

When these refrigerated pipelines traverse unfrozen ground or shallow permafrost where the soil is frost-susceptible, damage due to frost heaving is possible. Frost heaving can occur when water migrates toward the cold pipeline, collecting in layers of almost pure ice (ice lenses) beneath the pipeline. The resulting extra volume of ice causes soil deformation, usually in the form of heaving of the soil and pipeline above the lenses. The pipe may be heaved out of the ground in some cases. Moreover, the possibility of differential heave magnifies the threat to pipeline integrity. Differential heave occurs where the pipeline passes through adjacent soil zones that heave at different rates. For example, the pipeline may encounter a region of unfrozen frost-susceptible ground surrounded by permafrost. When this unfrozen ground freezes due to cooling by the pipeline, it will heave much more rapidly than the surrounding permafrost. The resulting differential heave can cause wrinkling and, ultimately, rupture of the pipeline.

Several methods have been proposed for dealing with the problem of frost heave of refrigerated gas pipelines, including replacing the frost-susceptible soil surrounding the pipeline with non-frost-susceptible soil and physically restraining the pipeline to prevent heave. Another solution proposed in the prior art has been to heavily insulate the pipeline and/or heat the soil beneath the pipeline in order to prevent formation of the ice lenses. A discussion of the problems and current approaches for operating refrigerated gas pipelines in permafrost and unfrozen soil may be found in A. C. Matthews, "Natural Gas Pipeline Design and Construction in Permafrost and Discontinuous Permafrost", SPE 6873 (1977).

While these methods provide some measure of relief from the problems of frost heaving, there are serious difficulties associated with each. These methods generally will involve specialized construction techniques, as where the pipelines are coated with insulation material and where individual electric heaters are installed. Careful surveillance and frequent adjustments of heating rates are also required. Further, adequate methods for monitoring pipeline heave are not yet available. Finally, these specialized techniques and apparatus inherently involve very high, possibly prohibitive costs due to the great length of a pipeline system requiring frost heave protection. Hundreds of transitions from frozen to thawed ground may be encountered with any major arctic gas pipeline. For example, precautions will be taken to protect the Alaska Highway Gas Pipeline from frost heave over at least an 80 mile length using some of the proposed techniques outlined above; for details, see *Oilweek*, page 20 (Apr. 17, 1978).

SUMMARY OF THE INVENTION

The present invention relates to a method of preventing excessive frost heaving of refrigerated gas pipelines which utilizes relatively low cost heat pipes to alleviate the above problems.

In accordance with this invention, heat pipes are installed in diametrically opposed pairs, one on either side of the pipeline, spaced along the length of pipeline traversing soil subject to frost heave. When heat pipes are utilized in this synergistic, paired fashion, long vertical frost bulbs are formed which thicken in a horizontal direction. This critical placement of heat pipes is a key aspect of this invention.

An important feature is that the frost bulbs surrounding the heat pipes tend to lower the frost front relative to the pipeline. By altering the pattern of heat and water flow, soil freezing and horizontal ice lense formation occur many feet below the pipeline where the temperature gradient in the vertical direction is small and the overburden is high. Moreover, the frozen soil around the pipeline tends to distribute heaving forces, thus reducing the effects of differential heaving.

Another feature of this invention is that most of the flow of water induced by soil freezing will be directed toward the heat pipes, thereby reducing the supply of water for horizontal lens formation directly beneath the pipeline. In addition, the downward movement of the frost front below the pipeline will be accelerated. After one or two winter seasons, the pipeline will be surrounded by a protective layer of frozen ground formed by frost bulbs around the heat pipes and pipeline.

Finally, the vertical frost bulbs provide opposing lateral forces which tend to counteract the upward force of any horizontal ice lenses growing beneath the pipeline.

The method of the present invention can be further enhanced by prefreezing the frost-susceptible soils using heat pipes before the pipe is laid. Thus, heat pipes are placed on either side of the proposed pipeline centerline prior to construction. Once the soil is frozen, a portion or all of these heat pipes are removed for ditching and pipe-laying operations. The heat pipes are then reinstalled subsequent to laying the pipeline.

While any passive heat extraction device can be used in the practice of this invention, the use of heat pipes is preferred since heat pipes are relatively low cost, highly efficient, and generally maintenance free, and do not require specialized construction techniques.

DESCRIPTION OF THE PREFERRED EMBODIMENT

Figure 1:
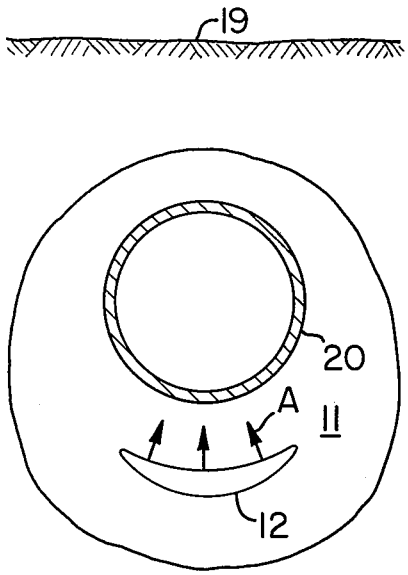
FIG. 1 is a schematic, cross sectional end view of a buried refrigerated gas pipeline without heat pipes installed.

FIG. 1 schematically depicts a buried refrigerated gas pipeline 20 surrounded by a frost bulb 11 having an oblong cross section and containing horizontal ice lense 12 exerting an upward force on the pipeline 20. Ice lense 12 is crescent shaped in cross section, but referred to herein as a horizontal lense to distinguish over vertical ice lenses that may form around heat pipes installed adjacent to pipeline 20. During operation of refrigerated gas pipeline 20, water tends to migrate through the soil and frost bulb 11 to a point beneath the pipeline where it freezes. Ice lense 12 forms beneath the pipeline simply because it is the coldest region of the temperature field around the pipeline. As more water migrates to this region, freezes and expands, the ice lense 12 thickens, exerting an upward pressure on pipeline 20. As it thickens, the ice lense 12 moves the soil and therefore pipeline 20 at a rate which depends on many factors, including the type of soil, the upward force distribution due to the thickening ice lense, the availability of water, and the overburden pressure. In some cases, the rate that ice lens 12 thickens, or the rate of frost heave, may be low enough so that pipeline deformation is inconsequential. Frequently, however, the rate of frost heave will be sufficiently high to cause serious problems in pipe deformation.

Figure 2:
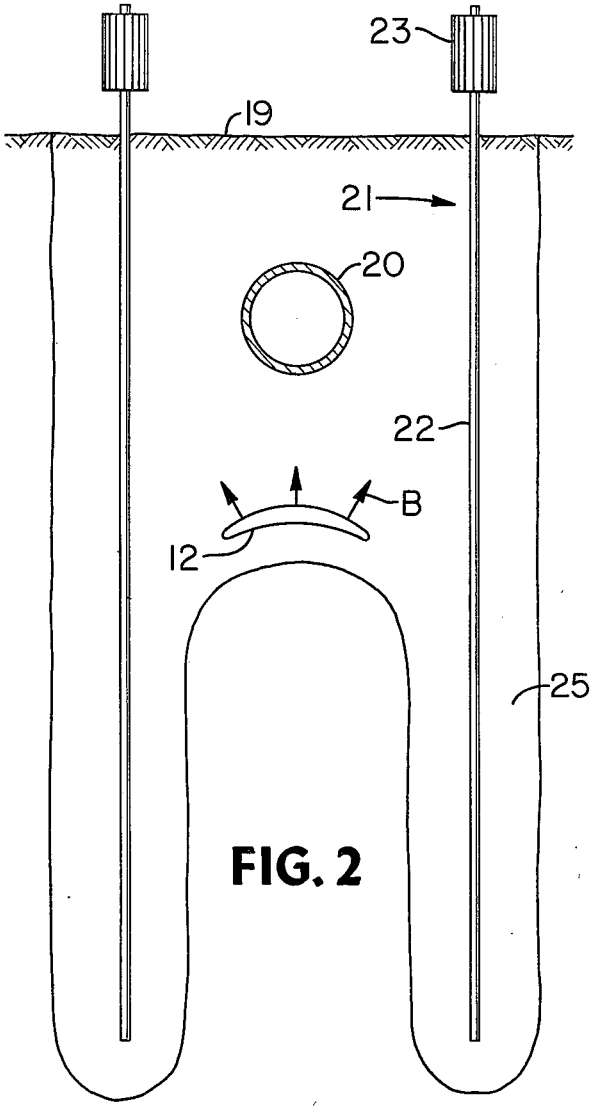
FIG. 2 is a schematic view, in partial section, of a pair of heat pipes adjacent a buried refrigerated gas pipeline.
Figure 3:
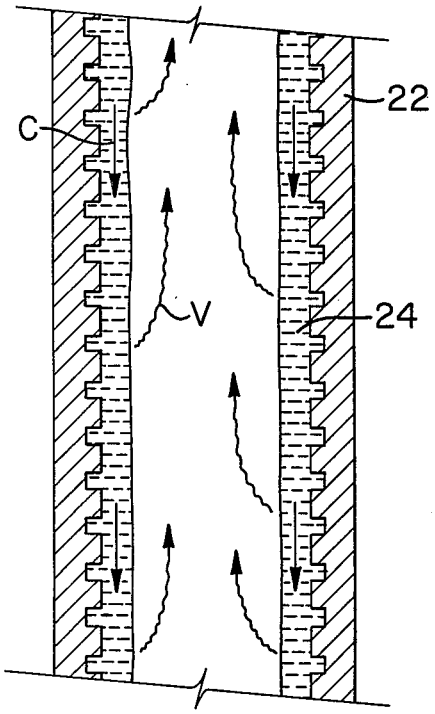
FIG. 3 is schematic cross section of a heat pipe.

FIG. 2 schematically illustrates the operation and effect of installing a pair of diametrically opposed heat pipes adjacent to a buried refrigerated gas pipeline 20. Heat pipe 21, portions of which are shown in greater detail in FIGS. 3 and 4, comprises a sealed tube 22, fitted with a finned radiator 23 at its upper end, and charged with a suitable refrigerant working fluid 24. As seen in FIG. 3, the inner surface of each sealed tube 22 is grooved or roughened in order to increase the surface area available for the evaporation/condensation process that takes place when the heat pipe is operated.

Suitable working fluids are characterized by a high latent heat of vaporization, high surface tension, low viscosity and, of course, an operating temperature range capable of freezing the soil. One specific suitable working fluid satisfying these requirements is ammonia; other suitable fluids will be readily apparent to those skilled in the art.

The heat pipe 21 is a natural convection, two-phase heat transfer loop which transfers heat by vaporization and condensation within a closed system. It operates only when the ambient temperature at the surface 19 is less than that of the soil; its operation is therefore generally seasonal and not continuous. When the surface temperature is warmer than the soil, the liquid/vapor cycle is interrupted so that heat is not transmitted back into the soil.

Figure 4:
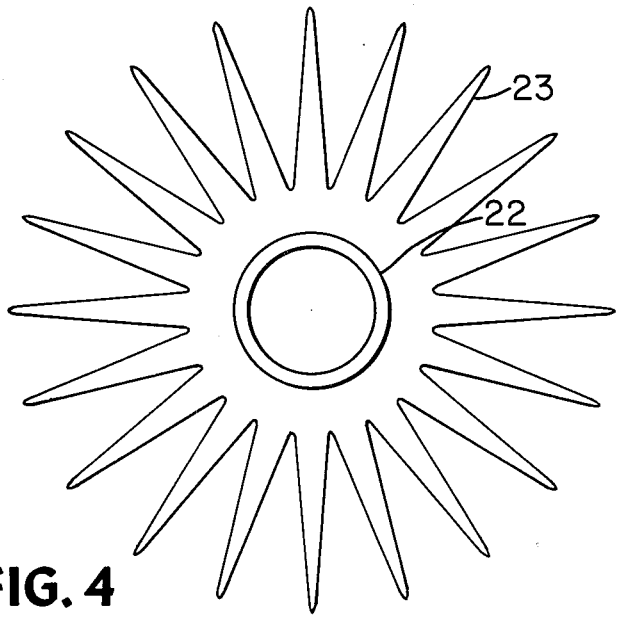
FIG. 4 is a schematic top view of a heat pipe taken along the line 4—4 indicated in FIG. 2.

In operation, heat from the soil enters the tube 22, causing the refrigerant 24 to boil. Vapor travels up the tube to the radiator 23 above the surface where it condenses on the cool surface and releases thermal energy. FIG. 3 includes arrows illustrating the direction of vapor (V) and condensate (C) flow. The finned radiator 23, shown in cross section in FIG. 4, is utilized in order to promote efficient and rapid heat dissipation to the atmosphere. The condensed refrigerant 24 then flows down the sides of tube 22, and the cycle is repeated. When the heat pipe is operating, heat from the soil is continously transferred to the surface where it is dissipated through the radiators. Heat pipe 21 will operate for as long as the soil temperature adjacent to any portion of the tube 22 is warmer than the ambient air temperature.

The design and construction techniques of suitable heat pipes for practicing the method described herein are well known. In general, however, suitable heat pipes will be capable of transferring heat from the soil to the surface with a temperature differential less than 0.5° F. Further details on heat pipes are provided in J. W. Galate, "Passive Refrigeration for Arctic Pile Supports", *Journal of Engineering for Industry*, Vol. 98, No. 2, p. 695 (May 1976). Specific suitable heat pipes for use in the present invention are described in a brochure entitled "Application of the Cryo-Anchor (TM) Stabilizer to Refrigerate Support Piles in Marginal Soils", McDonnell Douglas Astronautics Company Publication No. DWDL-721-063 (January 1972). Other suitable heat pipe designs will be readily apparent to those skilled in the art.

Refrigerated gas pipeline 20 is a large diameter, high pressure refrigerated gas transmission line. In general, the top of the pipeline will be at least 30 inches below the surface. Pipeline diameters may range from 36 inches to 56 inches. The diameter of the pipeline together with the operating pressures will govern the gas throughput and the required capacity of the associated compressing and cooling facilities. These large diameter pipelines are designed to operate at maximum pressures ranging from about 1000 to about 2100 psig. Combination cooling/compressor stations are located at intervals along the pipeline such that the gas can be maintained at a high pressure and at temperatures between about 10° and about 30° F., preferably from about 15° to about 25° F.

A detailed discussion of the design of one particular 48 inch diameter refrigerated gas pipeline and associated cooling/compresser facilities is given in the article by G. King, referred to above.

The method of the present invention alleviates the frost heaving problem which is associated with operating a refrigerated gas pipeline at the 10°-30° F. temperatures required for permafrost protection and efficient transportation of gas. In practicing the preferred embodiment, substantially diametrically opposed boreholes for accommodating the heat pipe are drilled on either side of the pipeline to a depth of about 30-50 feet. Boreholes are spaced on either side of the pipeline along the length to be protected from frost heave at approximately 8 to 12 foot intervals and are spaced approximately 2-8 feet from the edge of the pipeline. The spacing of the boreholes both laterally and along the length of the pipeline is primarily governed by the desired rate that the frost bulbs should form around the heat pipes 22. The spacing should be such that the frost bulbs around the heat pipes will merge with the frost bulb forming around the refrigerated pipeline 20 in about 3 to about 18 months after installation of the heat pipes. The frost bulbs of adjacent heat pipes on the same side of the pipeline should merge within approximately the same range of time.

Once the heat pipes have been installed, they will begin to function as soon as the ambient temperature at the surface is cooler than the soil temperature adjacent the lower portion of the heat pipe. During the cold season, frost bulbs 25 form around the heat pipe. Water tends to migrate not to horizontal ice lense 12 beneath pipeline 20, but migrates to heat pipes 22 where vertical ice lenses can form. With continued operation over a period of between about 3 and about 18 months, the frost bulbs 25 of heat pipes 21 gradually merge with the frost bulb 11 around the pipeline 20 and with adjacent heat pipe frost bulbs. The process will be quantitatively discussed later in the Example.

The benefits of this invention are due to the substantially diametrically opposed heat pipe pairs operating together in a synergistic fashion; the growth and merger of frost bulbs 25 with frost bulb 11 effectively alleviates frost heave problems due to several factors. Referring to FIG. 2, as the frost bulbs 25 around heat pipes 21 grow, the frost front below pipeline 20 is lowered. (The term "frost front" as used herein means the region below the pipeline having a temperature of 32° F., the freezing point of water.) This means that the depth of the region where water will freeze to form horizontal ice lense 12 becomes lowered relative to the pipeline. A corresponding increase in overburden pressure occurs simply due to the greater depth of potential ice lense formation; the greater overburden pressure is better able to counteract the upward force that ice lense 12 may exert. The rate of heaving decreases rapidly with increasing overburden.

Another effect of the heat pipes is to change the pattern of heat flow. Heat will preferentially flow to heat pipes 21, which are much more efficient heat exchangers than pipeline 20. The different heat flow pattern, along with the change in water migration direction may completely eliminate lensing. At a minimum, the shape of the horizontal ice lense which does form change from a concave configuration to approximately a convex configuration. The net effect of this change is to more evenly distribute the heaving forces due to the horizontal ice lense; force distributions are schematically represented in FIGS. 1 and 2 by vectors A and B respectively. Vectors A of FIG. 1 illustrate how the forces are concentrated on the pipeline when a horizontal ice lense forms below the pipeline with a concave configuration. As the configuration of the horizontal ice lenses changes to approximately a convex configuration as in FIG. 2, the forces are no longer concentrated, but instead are dissipated and directed away from the pipeline, as shown by vectors B.

Further, the rate that ice lense 12 forms will be decreased since water can now migrate to frost bulbs 25. In order to migrate to lense 12, the water must travel upwards between frost bulbs 25, and a large quantity will be removed before even reaching ice lense 12. Effectively, less water is available in the soil to migrate to ice lense 12. This also means that the size and growth rate of ice lense 12 are significantly decreased.

Finally, as frost bulbs 25 form and thicken adjacent to pipeline 20, opposing lateral confining forces are created tending to counteract the upward force of any horizontal ice lenses. These lateral confining forces increase as the front bulbs grow and merge. The formation of vertical ice lenses around heat pipes 21 increases these lateral forces, since they will tend to thicken in a horizontal direction.

In order to obtain all of these benefits, it is a key feature that the heat pipe pairs be substantially diametrically opposed; a staggered or other such configuration would not achieve these benefits, and in fact could increase frost heaving problems.

EXAMPLE

The benefits of this invention are achieved because diametrically opposed heat pipes operate together synergistically to reduce the frost heaving rate. Thus, the direction of water migration is altered; the permeability of the soil to water flow is lowered; the freeze front is lowered to greater depths beneath the pipeline; higher overburden pressures act to reduce heaving; and opposing lateral confining stresses are created.

Approximate two-dimensional thermal analysis of the heat pipe configuration disclosed herein was performed in order to estimate frost bulb growth rates and geometry.

The configuration considered consisted of two rows of heat pipes 21, one on either side of pipeline 20, with pairs of heat pipes opposite each other as depicted in FIG. 2 and generally discussed previously. The thermal analysis was performed in two steps. First, the frost bulb growth around the heat pipes before pipeline startup (e.g. pipeline at ambient temperature) was determined by simulating a horizontal plane through the heat pipes well below the buried pipeline (i.e. a plane perpendicular to the heat pipes). These results were then used to generate simulations of vertical planes through the pipeline (i.e. planes parallel to the heat pipes and perpendicular to the pipeline).

Analysis of the performance of the heat pipes was determined through the use of a computer program utilizing the mathematical relationship of Equation (1) below to simulate the behavior of heat pipes. The particulars of the computer program are not presented herein. Additional details on the programming approach are given in J. A. Wheeler, "Simulation of Heat Transfer from a Warm Pipeline Buried in Permafrost", presented at the Seventy-Fourth National Meeting of AIChE, New Orleans, Mar. 11-15, 1973; another example of the simulation techniques used can be found in the J. W. Galate reference cited above. One skilled in the art, given the mathematical formula presented below, could construct a program for duplicating the results presented herein. The relationship used was:

$$q = hA(T_s - T_a) \quad (1)$$

where:

q = heat flux from ground to the heat pipe (BTU/hr);
$T_s$ = soil temperature (°F.);
$T_a$ = air temperature (°F.);
A = circumferential area of the heat pipe ($ft^2$); and
h = overall heat transfer coefficient (BTU/$ft^2$°F.).

The overall heat transfer coefficient was assumed to be 3BTU/$ft^2$°F. hr. The relationship is valid only when the air temperature is colder than the ground temperature. Other input parameters are given below:

Soil Properties

A fine silt
Initial ambient temperature of 35° F.
Heat capacities of 40 BTU/$ft^3$ (thawed soil) and 27 BTU/$ft^3$ (frozen soil)
Thermal conductivities of 0.8 BTU/hrft°F. (frozen soil) and 1.2 BTU/hrft°F. (frozen soil)
Heat of fusion equal to 3700 BTU/$ft^3$ Pipeline 48 inch outside diameter
Wall temperature of 25° F. when operating Heat Pipes 2.5 inch outside diameter
Buried to a depth of 40 feet
Spaced 10 feet apart
Located 4 feet from the edge of the pipeline
Overal heat transfer coefficient of 3 BTU/hr$ft^2$°F.

Climatological

Based upon weather at Fairbanks, Alaska

Figure 5:
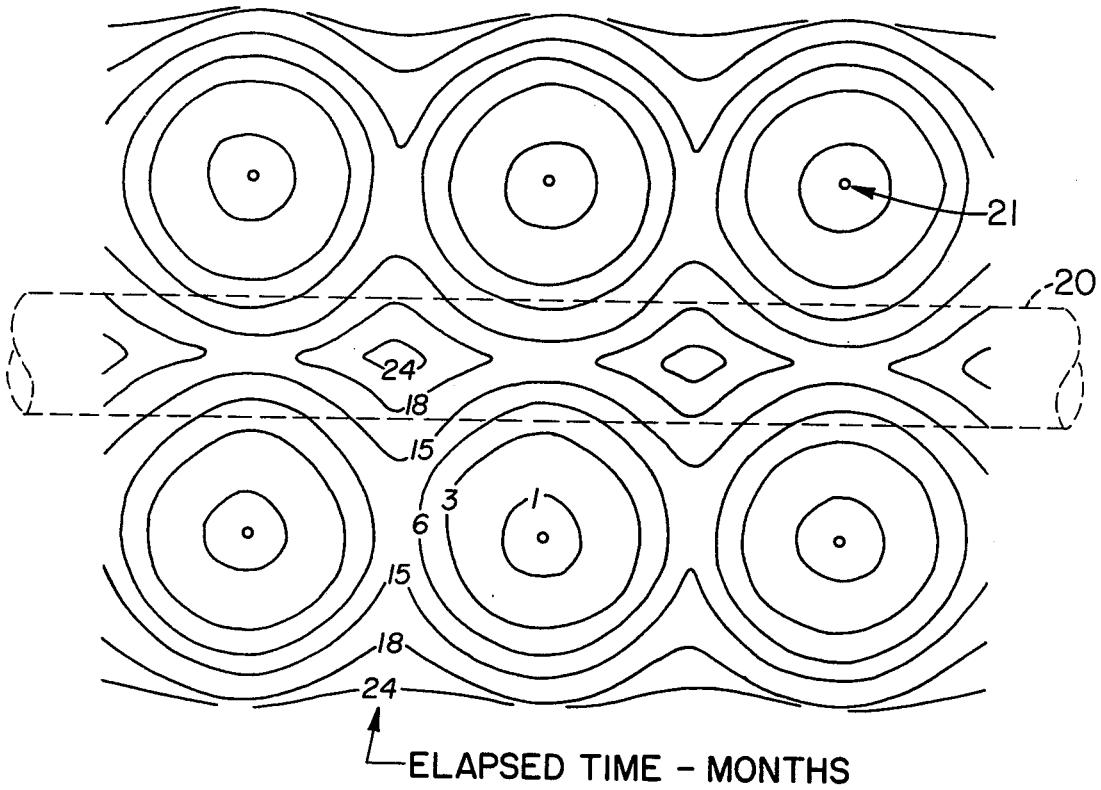
FIG. 5 is a schematic top view, partially in section, showing the growth of frost bulbs around the heat pipes.

FIG. 5 shows the frost bulb growth around the heat pipes 21 assuming that pipeline 20 has not yet been started up. (Pipeine 21 is represented by dashed lines in FIG. 5 to indicate that it lies above the region of soil where growth was simulated.) Frost bulbs for adjacent heat pipes will merge by the second winter, i.e. between 15 and 18 months after installation. The soil beneath the pipeline adjacent the heat pipes is completely frozen after just two years. These results all assume no pipeline startup, and indicate that the complete prefreezing of the soil surrounding a pipeline before startup may not be practical since a two year delay may be unacceptable. However, it may be preferred to prefreeze some portions of the soil in order to commence altering the direction of heat flow and water migration before any lenses whatsoever can form below the pipeline.

Therefore, the case was examined where the heat pipes 21 functioned for 6 winter months before pipeline startup. For the first 6 months of pipeline operation, the heat pipes provided no extra cooling, since the ambient air temperature was warmer than the soil (i.e. the pipeline was started at the beginning of summer).

Figure 6:
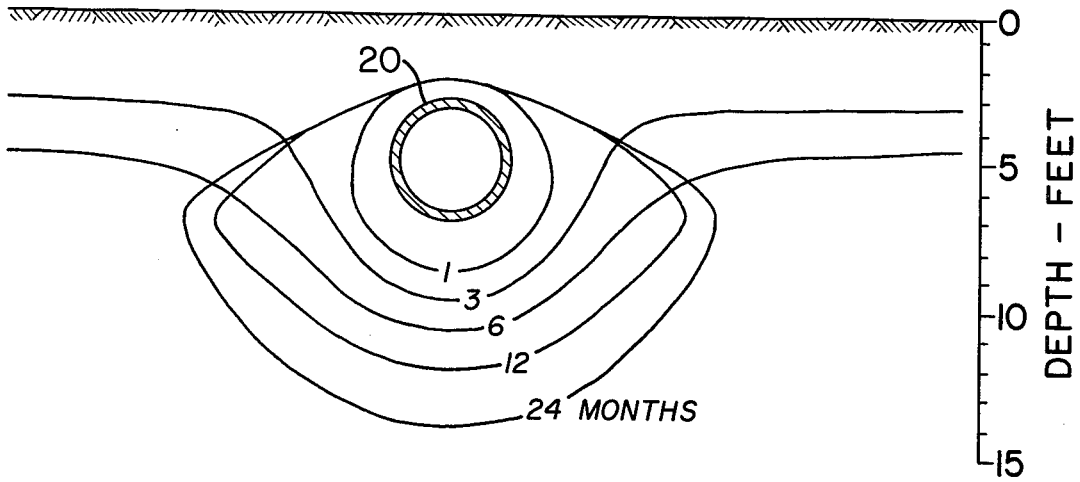
FIG. 6 is a schematic side view, in section, showing the frost bulb growth around a 25° F. pipeline without heat pipe protection.

As a basis for comparison, the frost bulb growth around the pipeline 20 with no heat pipe protection was determined and is depicted schematically in FIG. 6. The calculated frost penetrations of 5 feet below the pipeline in the first year and an additional 2 feet in the second year is in good agreement with data obtained by Northern Engineering Services Limited at their Calgary (Canada) test site. For this experimental data see W. A. Slusarchuk, et al., "Field Test Results of a Chilled Pipeline Buried in Unfrozen Ground", *Proceedings of the Third International Conference on Permafrost*, sponsored by the National Research Council of Canada, Vol. 1, pp. 877–883 (July 10–12, 1978). This paper also discusses some of the conventional monitoring and protective schemes aimed at mitigating frost heave.

Figure 7:
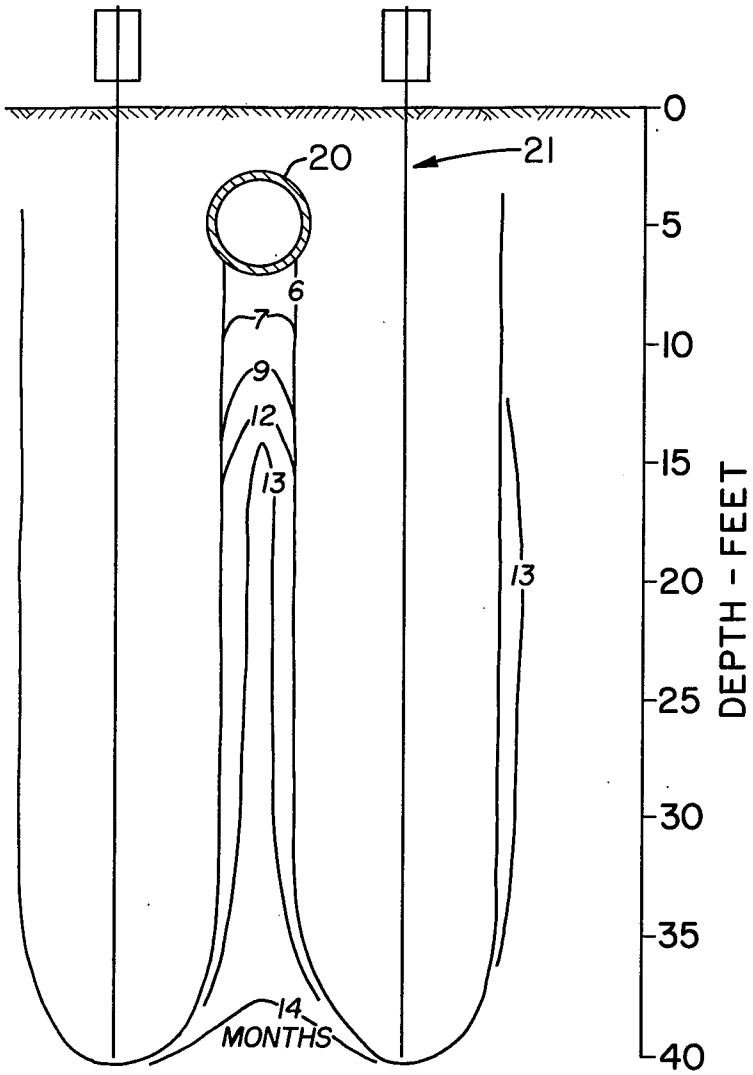
FIG. 7 is a schematic side view, in section, showing frost bulb growth in a vertical plane passing through opposite heat pipes.

Next, frost bulb growth in a vertical plane passing through opposite heat pipes 21 was estimated by thermal simulation with the temperatures at the heat pipes based upon prior simulation of heat pipe performance (e.g. using results of FIG. 5 in an iterative manner). As shown in FIG. 7, the frost bulb grows rapidly below the pipeline 20. The pipeline is completely frozen in after 14 months total or 8 months after pipeline startup. A beneficial alteration in the direction of heat flow and water migration is clearly evident at 7–9 months (1–3 months after pipeline startup).

Figure 8:
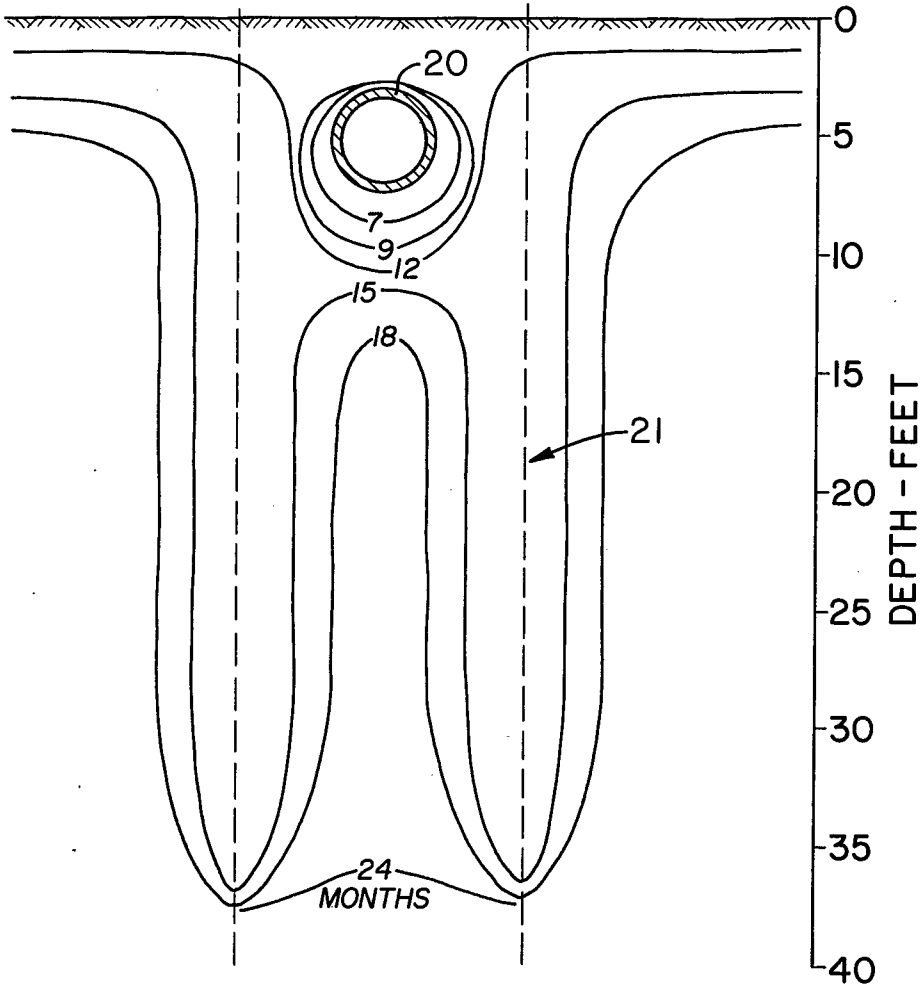
FIG. 8 is a schematic side view, in section, showing frost bulb growth in a vertical plane midway between adjacent heat pipes.

In a vertical plane midway between heat pipes, frost bulb growth is difficult to estimate accurately by inputting into the computer program temperatures at the intersection of the planes containing the heat pipes. The problem is that the heat and mass transfer induced by the heat pipes is perpendicular to this vertical plane midway between heat pipes. (The heat pipes 21 are represented by dashed lines to indicate that the simulation plane is midway between heat pipes.) However, an estimate of frost bulb growth was obtained by superimposing simulation results for the heat pipes alone and the pipeline alone. This was felt to give frost bulb growth rates slower than a rigorous three-dimensional simulation. The results, shown in FIG. 8, clearly indicate beneficial results after 12 months (6 months of pipeline operation) due to the altered direction of heat transfer. Moreover, this simulation does not take into account the beneficial effects of the heat pipes due to heat transfer perpendicular to the simulation plane. Hence, the actual benefits which would accrue should be better than the significantly improved results predicted according to FIG. 8.

These simulations of frost bulb growth rate and geometry clearly indicate that the frost heave problem is substantially eliminated during the second winter season. The soil below the pipeline is almost completely frozen to a depth of 40 feet, where overburden stresses, and lateral confining stresses should assure heave rates which are less than about 0.01 ft/year.

Also, the large, combined frost bulb around the pipeline provides protection against differential heave.

The method of the invention and the best mode contemplated for applying that method have been described. It should be understood that the foregoing is illustrative only and that other means and obvious modifications can be employed without departing from the true scope of the invention defined in the following claims.

What I claim is:

1. A method of limiting frost heaving of a buried refrigerated gas pipeline traversing frost-susceptible soil, said frost heaving being due to the upward force of a horizontal ice lense forming below said pipeline, which comprises:

(a) forming a first plurality of holes in said soil on one side of said pipeline;
(b) forming a second plurality of holes in said soil on the other side of said pipeline substantially opposite said first holes;

(c) placing means for passively removing heat from said soil in said holes resulting in a plurality of substantially opposed pairs of heat removing means, each of said heat removing means being extended from a depth below that at which ice lenses would otherwise form to the atmosphere to transfer heat from the soil to the atmosphere; and (d) passively cooling the soil adjacent to said pipeline by means of said heat removing means, said heat removing means operating in pairs to (i) lower the depth at which said horizontal ice lense can form, (ii) reduce the amount of water in soil available to form said horizontal ice lenses, and (iii) form vertical frost bulbs in said soil surrounding said heat removing means on both sides of said pipeline such that opposing lateral forces are created which tend to counteract said upward force.

2. The method of claim 1 wherein said holes are spaced at from about 8 to about 12 foot intervals along the length of said pipeline and spaced no more than about 8 feet from the edge of said pipeline.

3. The method of claim 1 wherein step (d) is accomplished using heat pipes.

4. The method of claim 3 wherein said heat pipes are placed such that said frost bulbs merge together within from about 3 to about 18 months from beginning of heat pipe operation.

5. A method for reducing the frost heaving rate of a buried refrigerated gas pipeline surrounded by a first frost bulb containing an ice lense exerting an upward force on said pipeline which comprises:

(a) installing pairs of substantially diametrically opposed heat pipes in the soil adjacent to and along the length of said pipeline, each pair being divided by said pipeline, each heat pipe being extended from the atmosphere to a depth below said ice lense to transfer heat from the adjacent soil to the atmosphere; and (b) passively cooling the soil around said heat pipes by means of said heat pipes such that long vertical frost bulbs form which grow to surround the portion of said heat pipes in the soil and which gradually merge with each other and with said first frost bulb, said heat pipe pairs operating together to lower the frost front beneath said pipeline thereby increasing the overburden pressure on said ice lense and to reduce the availability of water to form said ice lense.

6. The method of claim 5 wherein said pipeline operates within a temperature range of about 10° F. to about 30° F.

7. The method of claim 5 wherein said heat pipes are installed such that said frost bulbs merge within about 3 to about 18 months from beginning of heat pipe operation.

8. The method of claim 5 wherein said heat pipes are capable of transferring heat from said soil to the surface with a temperature differential of less than about 0.5° F.

9. The method of claim 8 wherein said heat pipes are installed to a depth of from about 30 to about 50 feet.

* * * * *